US005124760A

United States Patent [19]

Knapp et al.

[11] Patent Number: 5,124,760

[45] Date of Patent: Jun. 23, 1992

[54] METHOD AND APPARATUS FOR REGISTERING A SHEET

[75] Inventors: Thomas R. Knapp, Penfield; Michael H. Parsons, Rochester, both of N.Y.

[73] Assignee: Eastman Kodak Company, Rochester, N.Y.

[21] Appl. No.: 726,444

[22] Filed: Jul. 5, 1991

[51] Int. Cl.[5] ..... G03G 15/00

[52] U.S. Cl. ..... 355/317; 250/548

[58] Field of Search ..... 355/208, 271, 317; 346/134; 271/227; 250/548, 557

[56] References Cited

U.S. PATENT DOCUMENTS

| | | | |
|---|---|---|---|
| 3,888,579 | 6/1975 | Rodek et al. | 355/317 |
| 4,310,236 | 1/1982 | Connin | 355/317 |
| 4,416,534 | 11/1983 | Kluger | 355/317 |
| 4,519,700 | 5/1985 | Barker et al. | 355/271 |

*Primary Examiner*—Joan H. Pendegrass

*Attorney, Agent, or Firm*—Robert L. Randall

[57] ABSTRACT

A method and apparatus for registering a sheet member with an indicia on the surface of a moving member which comprises means for driving a sheet member substantially tangentially of the moving member and between the moving member and a linear image sensor which is disposed adjacent the surface of the moving member. The linear image sensor senses the leading edge of the sheet member and, as the moving member is driven, the linear image sensor senses the passage of the indicia on the surface thereof as the member travels therepast. The distance between the indicia and the leading edge of the sheet member is sensed and an error signal is generated representative of the distance. The sheet member driving means is regulated so as to reduce the error signal and the sheet is attached to the moving member when the error signal is reduced to a predetermined value.

10 Claims, 2 Drawing Sheets

METHOD AND APPARATUS FOR REGISTERING A SHEET

BACKGROUND OF THE INVENTION

1. Field of the Invention

The present invention relates to a method and apparatus for the control of movement of a sheet, so as to properly register it with a prescribed area on a moving member such as a drum or belt. Such drums and belts are used in xerographic copiers, printers, and the like. More particularly, the present invention relates to a method and apparatus for moving a copy sheet in a manner so as to align and synchronize movement of the sheet with an area of a member containing an image such as a toned electrostatic image associated with xerographic apparatus.

2. Description of the Prior Art

Xerographic and electrostatic copiers and printers impart an image to a copy sheet which is extracted from a supply and is fed to a drum or belt containing the image which is to be transferred to the sheet. Generally, this transfer is done while both the drum or belt and the sheet are moving to enhance the productivity of the apparatus. In order to assure that the image is satisfactorily aligned with the sheet, it is necessary to register the sheet with the drum or belt containing the image prior to the image transfer. When multiple images are to be registered to form a single image, such as when a series of mono-color images are superposed to form a full color image, even better registration is required. A variety of sheet registration devices are known in the prior art including mechanical gates which engage an edge of a sheet to hold it until the appropriate time and then release it for engagement with the image-bearing member. Typically, the gate is actuated by mechanical cams and switches, or the like, with the copy sheet, upon release, being driven by pinch rollers into registry with the image area as it passes the transfer zone. In such an arrangement, the pinch roller velocity is controlled to move the copy sheet at the same speed as the moveable member containing the image.

Some registration devices for copiers employ digital circuitry to monitor the image position and to control operation of the mechanical release gates and pinch roller drives. One example is shown in the IBM TECHNICAL DISCLOSURE BULLETIN of May 1980 (Volume 22, No. 12), in the article entitled "Servo-Controlled Paper Gate" by J. L. Cochran and J. A. Valent at pages 5,268–5,269. Digital circuitry shown in this article monitors the photoconductor image frame location and controls actuation of a mechanical copy sheet gate as well as the DC motor drive for the copy sheet to bring the speed of the copy sheet up to the speed of the photoconductor as it engages the image panel.

Another application of digital controls for copy sheet alignment is shown in U.S. Pat. No. 4,310,236 by J. L. Connin, filed Oct. 12, 1979, wherein stepper motors are used to position mechanical gates so that the copy sheets are fed with a skew that conforms to the original document skew as it was imaged onto a photoconductor belt. A logic and control unit monitors the photoconductor image location as it moves and digitally compensates for the skew as measured by sensors at the original document when it was imaged onto the photoconductor.

It is also known to utilize stepper motors to control the movement and positioning of original documents presented for scanning by a copier. For example, U.S. Pat. No. 3,888,579 by V. Rodek et al., filed Jan. 31, 1974, shows a combination of stepper motors and rollers, sheet detectors and controls that function to release the original documents so that the document image correlates to a predetermined image area on the photoconductor. It is thus known to monitor the photoconductor image zone location and to sense with a photocell the movement of an original document to control release of that document so that it passes a scanning window with a velocity compatible with the photoconductor velocity. And further, with the proper timing, it is possible to place the original document image in the predetermined image zone on the moving photoconductor.

However, such prior art registration systems can cause slippage or scrubbing of the copy sheet by the drive members or pinch rollers while it is waiting release by the gate to the image transfer area, thus creating an area thereon which can adversely affect the image. Moreover, the edge of the sheet is often indented or buckled by the gate, particularly when light-weight paper is being used, which further adversely impacts on the registration when the gates are released.

More significantly, prior art registration devices generally require very close tolerances and careful alignment of the detectors with the other components of the image transfer apparatus. As a result, even though the prior art registration systems may operate satisfactorily, they require lengthy, costly setup when the apparatus is assembled, plus careful maintenance over the life of the apparatus. All of this contributes to increased costs and maintenance over the life of the apparatus.

Accordingly, a registration system that is easily set up and requires a minimum of maintenance and which reliably registers a sheet with a moving member for the transference of an image would be extremely desirable.

SUMMARY OF THE INVENTION

According to one aspect of the present invention, a method of registering a sheet member with an indicia on the surface of a moving member is provided which comprises the steps of driving a sheet member with a driving means substantially tangentially of the moving member and between the moving member and a linear image sensor which is disposed adjacent the surface of the moving member. The linear image sensor senses the leading edge of the sheet member and, as the moving member is driven, the linear image sensor senses the passage of the indicia on the surface thereof as the member travels therepast. The distance between the indicia and the leading edge of the sheet member is sensed and an error signal is generated representative of the distance. The driving means is regulated so as to reduce the error signal and the sheet is attached to the moving member when the error signal is reduced to a predetermined value.

According to another aspect of the present invention, a sheet registration device is provided for registering a sheet member with an axially extending indicia on the reflective surface of a rotating drum member. A linear image sensor is disposed closely tangential to the periphery of the drum member with the axis of the sensor perpendicular to the drum axis. A sheet member motive means is arranged to drive the sheet member substantially tangential of the drum member and between the drum member and the linear image sensor. Means is provided for projecting a light on to the reflective surface of the drum to be reflected therefrom toward the linear image sensor. The linear image sensor is arranged to sense the leading edge of the sheet member as it blocks the light reflected to the linear image sensor. Means is provided for stopping the sheet member at a preselected location, and drive means is provided for rotating the drum member. The linear image sensor is arrange to sense the passage of the indicia as the drum member is rotated therepast by the interruption by the indicia of the light reflected to the linear image sensor. Means is provided for sensing the distance between the indicia and the leading edge of the sheet member and for generating an error signal representative of that distance. Means is provided for actuating the motive means to advance the sheet member and further means is provided for controlling the motive means so as to reduce the error signal. And means is provided for attaching the sheet to the drum member when the error signal is reduced to a predetermined value.

Various means for practicing the invention and other features and advantages thereof will be apparent from the following detailed description of an illustrative preferred embodiment of the invention, reference being made to the accompanying drawings.

DESCRIPTION OF THE PREFERRED EMBODIMENT

Figure 1:
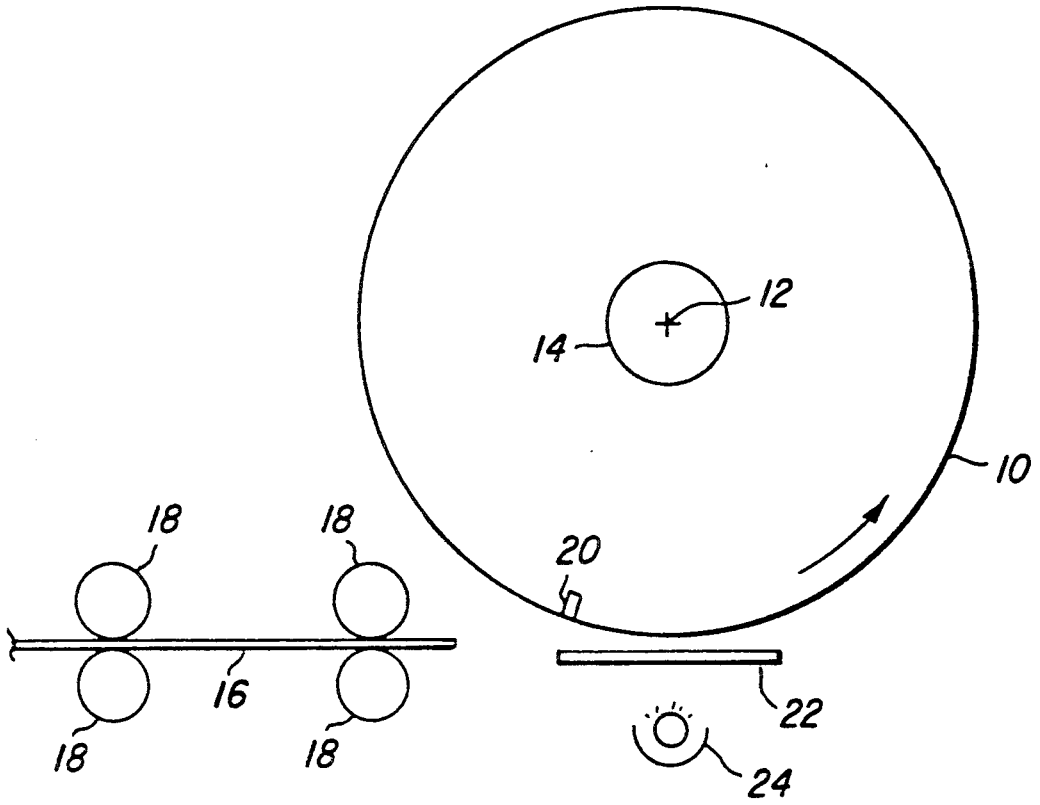
FIG. 1 is a schematic side view of a sheet member drive and rotary drum assembly.
Figure 2:
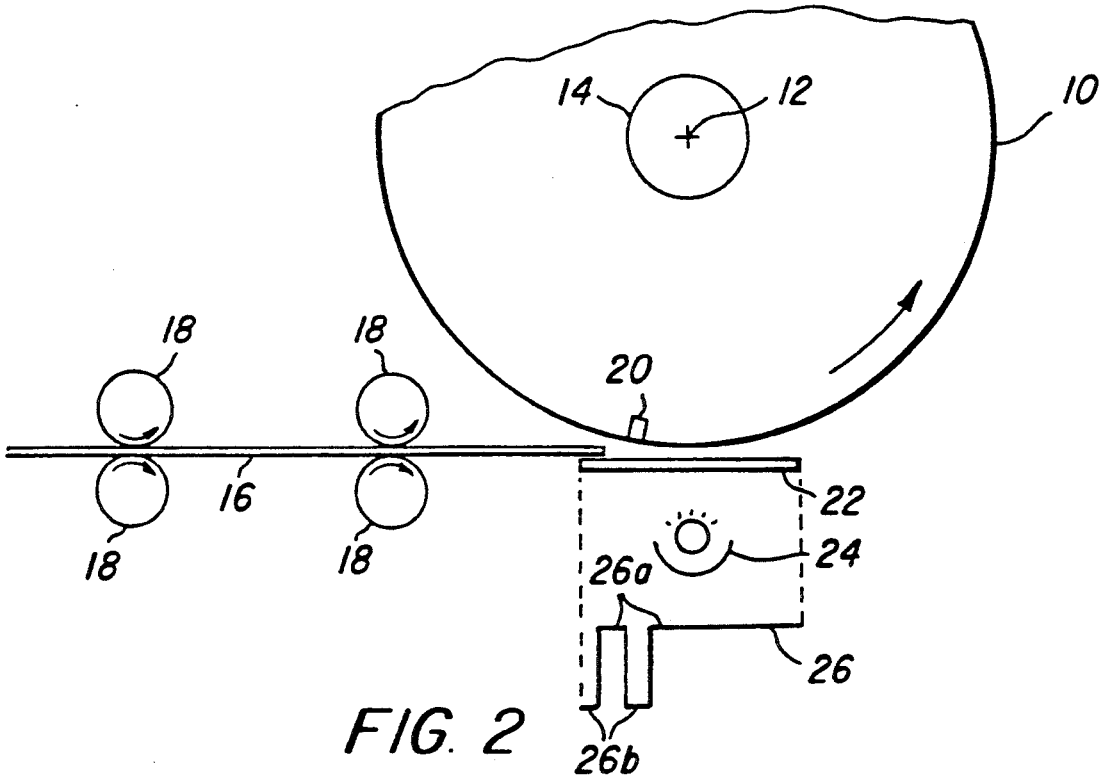
FIG. 2 is a side view similar to FIG. 1 with the sheet member being driven into registration with the indicia on the drum member.
Figure 3:
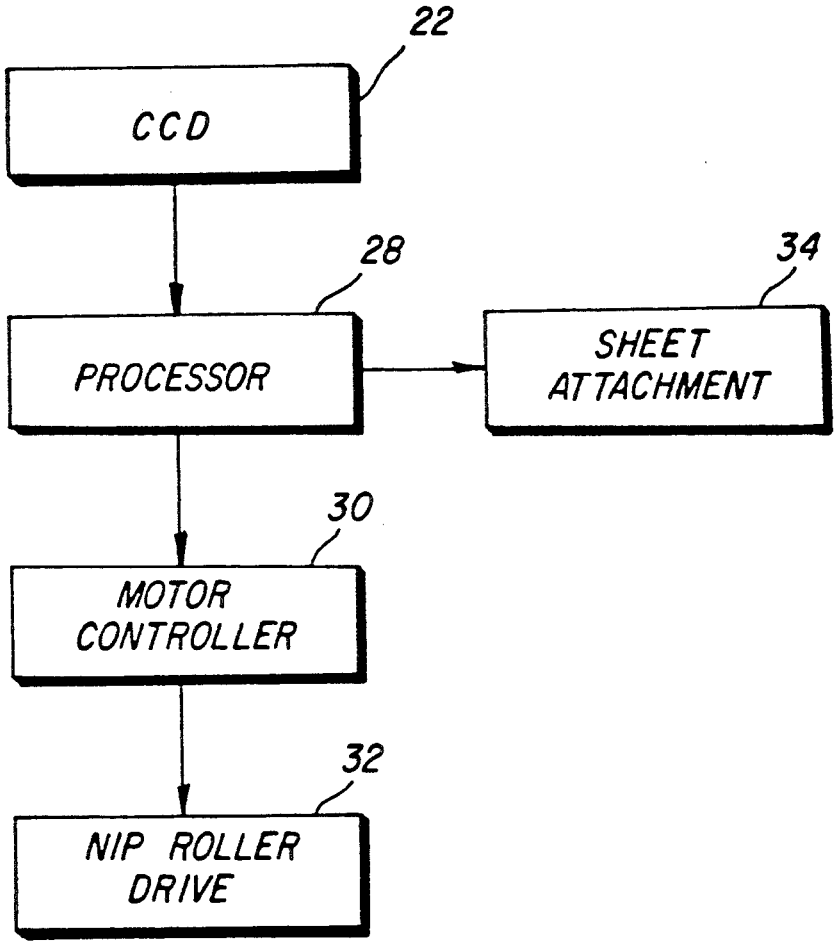
FIG. 3 is a logic chart of the operation of the sheet registering apparatus.

A schematic illustration of a preferred embodiment of the present invention is illustrated in FIGS. 1-3 and includes an image transferring drum 10 which is rotated by a motor 14 about an axis 12. The drum is provided with a reflective outer surface and is arranged to carry an image for transferral to a sheet member 16. The sheet member is provided from a sheet supply means (not shown) adjacent the drum and, after withdrawal from the supply means, is engaged by sheet driving means, such as two pairs of driven nip rollers 18. The nip rollers engage the sheet and are arranged to stop it at a predetermined location adjacent the drum 10 (see FIG. 1). Upon the appropriate control signal, the nip rollers are arranged to drive the sheet tangentially of the drum for attachment thereto.

The drum is provided with a non-reflecting indicia 20 on the surface thereof which extends substantially parallel with the drum axis 12. A linear image sensor 22 is disposed close to the periphery of the drum surface and tangentially thereof, with the axis of the sensor disposed perpendicular to the drum axis. A light source 24 is disposed adjacent the drum and is arranged to project a light onto the reflective surface thereof to be reflected to the linear image sensor 22. The linear image sensor 22 is disposed so that, when the sheet member 16 is driven tangentially of the drum 10, it passes between the linear image sensor and the drum surface. The axial indicia 20 on the surface of the drum is located at the point of sheet attachment for the desired registration thereof, or at a predetermined distance from the point of attachment, as will be more thoroughly described hereinbelow.

The linear image sensor 22 is preferably a multiple element, linear charge coupled device, CCD, such as model TCD 133D manufactured by Toshiba, which has 2,048 image sensing elements each having a width of about 14 microns, with the overall length of the sensor being approximately 2.86 centimeters. Each image sensing element generates an output when it is illuminated. Thus, when the light from light source 24 is reflected from the drum surface to the linear image sensor 22, the sensor produces an output from each of the image sensing elements unless the reflection is prevented as by the indicia 20, or is blocked by the sheet 16, in which case the unilluminated element does not produce an output. Thus, when the sheet 16 has been advanced by the nip rollers 18 and the indicia 20 has been advanced by the rotation of the drum 10, as illustrated in FIG. 2, the output of the linear image sensor 22 can be portrayed as indicated by line 26, wherein the image sensing elements which are illuminated will produce a high output **26*a*, and the image sensing elements which are prevented from receiving illumination by either the leading edge of the sheet 16 or by the non-reflective indicia 20, will produce little or no output as indicated by 26*b***.

In operation, the drum 10 is driven at the preselected speed and the light source 24 is actuated to illuminate the reflective surface of the drum. The sheet member 16 to be attached to the drum is advanced by the nip rollers 18 until the leading edge thereof blocks or covers a small number, e.g. less than 10%, of the image sensing elements at the first edge of the linear image sensor 22. The nip rollers 18 are then stopped to position the sheet member as illustrated in FIG. 2. The drum continues to rotate until the indicia 20 reaches the position indicated in FIG. 2, downstream from the edge of the sheet member 16, that is in the direction in which the sheet member moves. The signal processor 28 is arranged to wait until there is a finite distance between the indicia 20 and the edge of the sheet member 16 so that the signal produced by the linear image sensor is as illustrated in FIG. 2. The processor is arranged to measure the high level output **26*a* between the two low level outputs 26*b* and to generate an output as an error signal which is delivered to a motor controller 30 which controls the nip roller drive 32 to drive the sheet member 16 tangentially of the rotating drum 10. The motor controller is regulated so as to reduce the error signal to a predetermined non-negative value representative of an acceptable registration tolerance between the edge of the sheet member and the desired registration position on the drum. When the error signal is reduced to this predetermined value, as sensed by the linear image sensor 22 and identified by the processor 28, the processor actuates a sheet attachment mechanism 34** on the drum, e.g. a vacuum hold-down, to attach the sheet member to the drum.

Alternative Embodiment

While the preferred embodiment has been described with respect to an image transferring system in which the drum onto which the sheet member is registered carries the image to be transferred, it will be appreciated that the invention disclosed can also operate satisfactorily in an arrangement wherein the drum onto which the sheet is registered does not itself carry the image, but is itself registered with another drum which does carry an image to be transferred to the sheet.

Further, it will be appreciated that the present invention can also operate satisfactorily in a system utilizing an endless belt instead of a rotating drum member. In this arrangement, the belt will be provided with an indicia associated with each registration location on the belt.

Inasmuch as the control of the placement of the sheet member with respect to the desired registration location is completely controlled by the signal produced by the linear image sensor, and since the "images" of the edge of the sheet member and the indicia are both projected onto the image sensor simultaneously, drum runout, positional tolerances, and other changes and variations in the physical dimensions of the system do not affect the registration of the sheet. Thus, the placement of the linear image sensor, and the location of the sheet member drive with respect to the drum or the belt during assembly are not critical and thus do not require time-consuming and costly precision set-up and calibration. Moreover, should any system temperature changes affect the size or location of any of the components, the self-calibrating nature of the present invention continues to determine the correct registration of the sheet without requiring any additional compensation for the temperature variations. Still further, since the registration system is self-calibrating, maintenance thereof throughout its life is minimal, and even component replacement requires no precision placement or alignment of the parts.

The invention has been described in detail with particular reference to a presently preferred embodiment, but it will be understood that variations and modifications can be effected within the spirit and scope of the invention.

We claim:

1. A method of registering a sheet member with an indicia on the surface of a moving member comprising the steps of driving a sheet member with a driving means substantially tangentially of said moving member and between said member and a linear image sensor disposed adjacent the surface of said moving member, sensing the leading edge of said sheet member with said linear image sensor, driving said moving member and sensing the passage of said indicia with said linear image sensor as said moving member travels therepast, sensing the distance between said indicia and the leading edge of said sheet member and generating an error signal representative of said distance, regulating said sheet driving means so as to reduce said error signal, and attaching said sheet to said moving member when said error signal is reduced to a predetermined value.

2. A method of registering a sheet member according to claim 1 including the step of projecting a light onto the surface of said moving member to be reflected therefrom toward said linear image sensor.

3. A method of registering a sheet member according to claim 2 wherein said sheet member and said indicia block the reflected light from reaching the linear image sensor.

4. A method of registering a sheet member according to claim 1 wherein said sheet is attached to said moving member by providing a vacuum to said moving member surface.

5. A method of registering a sheet member with an axially extending indicia on the reflective surface of a rotating drum member comprising the steps of operating a sheet member motive means to drive said sheet member substantially tangentially of said drum member and between said drum member and a linear image sensor disposed closely tangential to the periphery of said drum member with the axis of the linear sensor perpendicular to the drum axis, projecting a light onto said reflective surface of said drum to be reflected therefrom toward said linear image sensor, sensing the leading edge of said sheet member by the blockage by the sheet of the light reflected to said linear image sensor and stopping said sheet member, rotating said drum member and sensing the passage of said indicia by the interruption by the indicia of the light reflected to said linear image sensor as said drum member is rotated therepast, sensing the distance between said indicia and the leading edge of said sheet member and generating an error signal representative of said distance, actuating said motive means to advance said sheet member, regulating said motive means so as to reduce said error signal, and attaching said sheet to said drum member when said error signal is reduced to a predetermined value.

6. A sheet registration device for registering a sheet member with an indicia on the surface of a moving member comprising a linear image sensor disposed adjacent the surface of said moving member, a sheet member motive means arranged to drive said sheet member substantially tangentially of said moving member and between said moving member and said linear image sensor, said linear image sensor being arranged to sense the leading edge of said sheet member as it approaches said moving member, means for driving said moving member, said linear image sensor being arranged to sense the passage of said indicia as said moving member is driven therepast, means for sensing the distance between said indicia and the leading edge of said sheet member and for generating an error signal representative of said distance, means for controlling said sheet member motive means so as to reduce said error signal, and means for attaching said sheet to said moving member when said error signal is reduced to a predetermined value.

7. A sheet registering device according to claim 6 including means for projecting a light onto the surface of said moving member to be reflected therefrom toward said linear image sensor.

8. A sheet registering device according to claim 7 wherein said sheet member an said indicia are arranged to block the reflected light from reaching the linear image sensor to generate a signal from said sensor.

9. A sheet registering device according to claim 6 wherein means is provided for supplying a vacuum to said drum surface to attach said sheet thereto.

10. A sheet registration device for registering a sheet member with an axially extending indicia on the reflective surface of a rotating drum member comprising a linear image sensor disposed closely tangential to the periphery of said drum member with the axis of the linear sensor perpendicular to the drum axis, a sheet member motive means arranged to drive said sheet member substantially tangentially of said drum member and between said drum member and said linear image sensor, means for projecting a light onto said reflective surface of said drum to be reflected therefrom toward said linear image sensor, said linear image sensor being arranged to sense the leading edge of said sheet member as it blocks the light reflected to said linear image sensor, means for stopping said sheet member at a preselected location, drive means for rotating said drum member, said linear image sensor being arranged to sense the passage of said indicia as said drum member is rotated therepast by the interruption by the indicia of the light reflected to said linear image sensor, means for sensing the distance between said indicia and the leading edge of said sheet member and for generating an error signal representative of said distance, means for actuating said motive means to advance said sheet member, means for controlling said motive means so as to reduce said error signal, and means for attaching said sheet to said drum member when said error signal is reduced to a predetermined value.

* * * * *